US007762288B2

(12) United States Patent
Puissant

(10) Patent No.: US 7,762,288 B2
(45) Date of Patent: Jul. 27, 2010

(54) METHOD FOR INSERTION OF A WEFT THREAD ON A WEAVING LOOM, AND A WEAVING LOOM

(75) Inventor: Patrick Puissant, Merelbeke (BE)

(73) Assignee: PICANOL N.V., Leper (BE)

( * ) Notice: Subject to any disclaimer, the term of this patent is extended or adjusted under 35 U.S.C. 154(b) by 73 days.

(21) Appl. No.: 12/085,636

(22) PCT Filed: Dec. 15, 2006

(86) PCT No.: PCT/EP2006/012119

§ 371 (c)(1),
(2), (4) Date: May 28, 2008

(87) PCT Pub. No.: WO2007/071350

PCT Pub. Date: Jun. 28, 2007

(65) Prior Publication Data

US 2009/0165885 A1 Jul. 2, 2009

(30) Foreign Application Priority Data

Dec. 20, 2005 (BE) ..... 2005/0612

(51) Int. Cl.
*D03D 47/30* (2006.01)
*D03D 49/50* (2006.01)

(52) U.S. Cl. ..... 139/435.2; 139/452; 139/116.1; 139/370.2; 700/140; 700/130

(58) Field of Classification Search ... 139/435.1–435.6, 139/452; 700/140
See application file for complete search history.

(56) References Cited

U.S. PATENT DOCUMENTS 4,446,893 A * 5/1984 Gunneman et al. ..... 139/11
4,590,972 A * 5/1986 Sugita et al. ..... 139/435.2
4,625,770 A * 12/1986 Ishikawa ..... 139/336
4,658,865 A * 4/1987 Gotoh ..... 139/435.2
4,673,004 A * 6/1987 Rosseel et al. ..... 139/435.2
4,702,285 A * 10/1987 Sugita ..... 139/452
4,722,370 A * 2/1988 Manders ..... 139/429
4,744,393 A * 5/1988 Takegawa ..... 139/116.2
4,781,224 A * 11/1988 Gotoh et al. ..... 139/435.2
4,815,501 A * 3/1989 Takehana ..... 139/429
4,827,986 A * 5/1989 Tanaka ..... 139/337
4,827,990 A * 5/1989 Takegawa ..... 139/435.2
4,877,064 A * 10/1989 Pezzoli ..... 139/435.1
4,901,770 A * 2/1990 Takegawa ..... 139/435.2
5,095,953 A * 3/1992 Makino ..... 139/435.2
5,107,902 A * 4/1992 Wahhoud ..... 139/435.1

(Continued)

OTHER PUBLICATIONS

Search Report prepared by the European Patent Office regarding Belgium Patent Application No. 2005/0612, Jul. 27, 2006.

*Primary Examiner*—Bobby H Muromoto, Jr.
(74) *Attorney, Agent, or Firm*—Bacon & Thomas, PLLC

(57) ABSTRACT

A method for insertion of a weft thread (2, 3, 4) on a weaving loom whereby insertion parameter is determined and in which on the one hand at least one control parameter for an insertion is adapted or, on the other hand, at least one control parameter for a weaving cycle is adapted. A weaving loom with control devices (41,42) and a selection device (43) for the application of a method as stated above.

16 Claims, 1 Drawing Sheet

U.S. PATENT DOCUMENTS 5,115,840 A * 5/1992 Yamada ..... 139/435.2
5,134,568 A * 7/1992 Sainen ..... 700/140
5,293,907 A * 3/1994 Tamura ..... 139/1 E
5,322,089 A * 6/1994 Yamada ..... 139/435.2
5,421,378 A * 6/1995 Bowers et al. ..... 139/435.1
5,440,495 A * 8/1995 Sainen et al. ..... 700/140
5,503,197 A * 4/1996 Bower et al. ..... 139/435.1
6,142,190 A * 11/2000 Nakada et al. ..... 139/435.5
6,314,335 B1 * 11/2001 Sainen et al. ..... 700/140
6,748,981 B2 * 6/2004 Gielen et al. ..... 139/435.2
7,055,554 B2 * 6/2006 Fujitani ..... 139/435.2
7,063,109 B2 * 6/2006 Siegl et al. ..... 139/435.2
7,110,847 B2 * 9/2006 Ostyn ..... 700/140
2002/0005224 A1 * 1/2002 Schiller et al. ..... 139/435.1
2002/0026962 A1 * 3/2002 Banba et al. ..... 139/435.1
2003/0140980 A1 * 7/2003 Ostyn ..... 139/1 B
2004/0244860 A1 * 12/2004 Peeters et al. ..... 139/11
2007/0169831 A1 * 7/2007 Gorris et al. ..... 139/450
2008/0216912 A1 * 9/2008 Puissant et al. ..... 139/435.2
2009/0084461 A1 * 4/2009 Puissant ..... 139/452
2009/0120524 A1 * 5/2009 Puissant ..... 139/194
2009/0165885 A1 * 7/2009 Puissant ..... 139/434

* cited by examiner

METHOD FOR INSERTION OF A WEFT THREAD ON A WEAVING LOOM, AND A WEAVING LOOM

BACKGROUND OF THE INVENTION

1. Field of the Invention

The invention relates to a method for insertion of a weft thread on a weaving loom whereby an insertion parameter is determined. The invention also relates to a weaving loom for the application of such a method, in other words a weaving loom that applies a method as stated above.

2. Description of Related Art

Weaving looms in which compressed air is supplied to a blower comprise one or more main blowers and a number of secondary blowers for insertion of a weft thread into a weaving shed. On such weaving looms where different types of weft threads are inserted into a weaving shed according to a pattern, a corresponding set of main blowers with a corresponding supply device for compressed air is provided for each of these weft threads. The compressed air is supplied, for example, by an appropriate control of shut-off valves installed between a reservoir with compressed air and corresponding main blowers and/or secondary blowers. The amount of compressed air supplied can be regulated here by means of a motor-controlled throttle valve installed between the reservoir and a corresponding main blower and/or secondary blower. Such a motor-controlled throttle valve comprises for example a controllable stepping motor that can be controlled in both directions with a desired number of steps by means of a control unit.

The control of the amount of compressed air supplied during weaving as a function of a deviation from a measured insertion parameter is well known. It is possible here, for example, to control the amount of compressed air supplied in such a way that an inserted weft thread reaches the end of the weaving shed at a more or less desired angular position of the weaving loom. According to one possibility, a mean deviation is determined here between the moment at which the weft thread reaches the end of the weaving shed and the moment at which the mean drive shaft of the weaving loom reaches a given angular position. The throttle valve is then controlled, for example, in such a way that the mean deviation for insertions becomes more or less equal to a given value.

It is also possible to control the rotational speed of the weaving loom during weaving as a function of a deviation from a measured insertion parameter. For example, as described in NL 7908357 A, to control this rotational speed in such a way that the time required to insert a weft thread into a weaving shed takes a more or less constant proportion of the actual time for a weaving cycle determined by the rotational speed of the weaving loom. A weaving cycle is determined i.a. by a given time necessary for one revolution of the weaving loom, in other words by the weaving speed of the weaving loom or the rotational speed of the weaving loom. One weft thread is normally inserted into a weaving shed during one revolution of the weaving loom.

SUMMARY OF THE INVENTION

An object of the invention is a method and a weaving loom that permit a control parameter to be adapted in a controlled manner.

This object is achieved by a method according to the present invention, more particularly a method according to the invention comprises on the one hand adapting at least one control parameter for an insertion according to an algorithm and, on the other hand, adapting at least one control parameter for a weaving cycle according to an algorithm. Such an adaptation can be performed as a function of one or more insertion parameters and/or of one or more control parameters for an insertion and/or of one or more control parameters for a weaving cycle.

Through an appropriate choice or the appropriate selection of an algorithm or method for adaption of a control parameter for an insertion or of a control parameter for a weaving cycle, it is possible to increase the production of woven fabric without having a negative influence on the quality of the produced woven fabric and/or of the weaving efficiency of the weaving loom. This permits i.a. a controlled variation of the weaving loom rotational speed as a function of one or more measured insertion parameters, without the risk of the number of stoppages in weaving increasing significantly due to an incorrectly inserted weft thread. This also permits i.a. a selected control parameter to be regulated as a function of a mean deviation from one or more current or measured insertion parameters. The selection of a given algorithm according to a method according to the invention allows the above-mentioned advantages to be achieved and the control parameters to be advantageously adapted.

According to an advantageous embodiment, the method comprises the input of one or more basic values for a control parameter and/or the input of one or more limit values for a control parameter. Such basic values and limit values can be used to selectively control either a control parameter for an insertion or a control parameter for a weaving cycle according to a given algorithm.

The object of the invention is achieved by a weaving loom using the apparatus disclosed herein. More particularly a weaving loom according to the invention comprises a control device for a control parameter for an insertion, a control device for control parameter for a weaving cycle and a selection device that controls the control device for the control parameter for an insertion or the control device for a control parameter for a weaving cycle. Such as selection device preferably operates together with an evaluating device for determining a representative value for one or more actual insertion parameters. This permits a control parameter to be regulated as a function of such a value. For example, an evaluating device for determining the difference in time between a measured moment when a weft thread arrives at a thread monitor and a reference moment in the weaving cycle and for determining a representative mean value for this different in time. This permit i.a. a control parameter to be regulated as a function of a mean deviation from a current insertion parameter.

BRIEF DESCRIPTION OF THE DRAWING

Further characteristics and advantages of the invention can be found in the following description of the illustrative embodiment shown in the drawing.

DETAILED DESCRIPTION OF THE PREFERRED EMBODIMENTS

Figure 1:
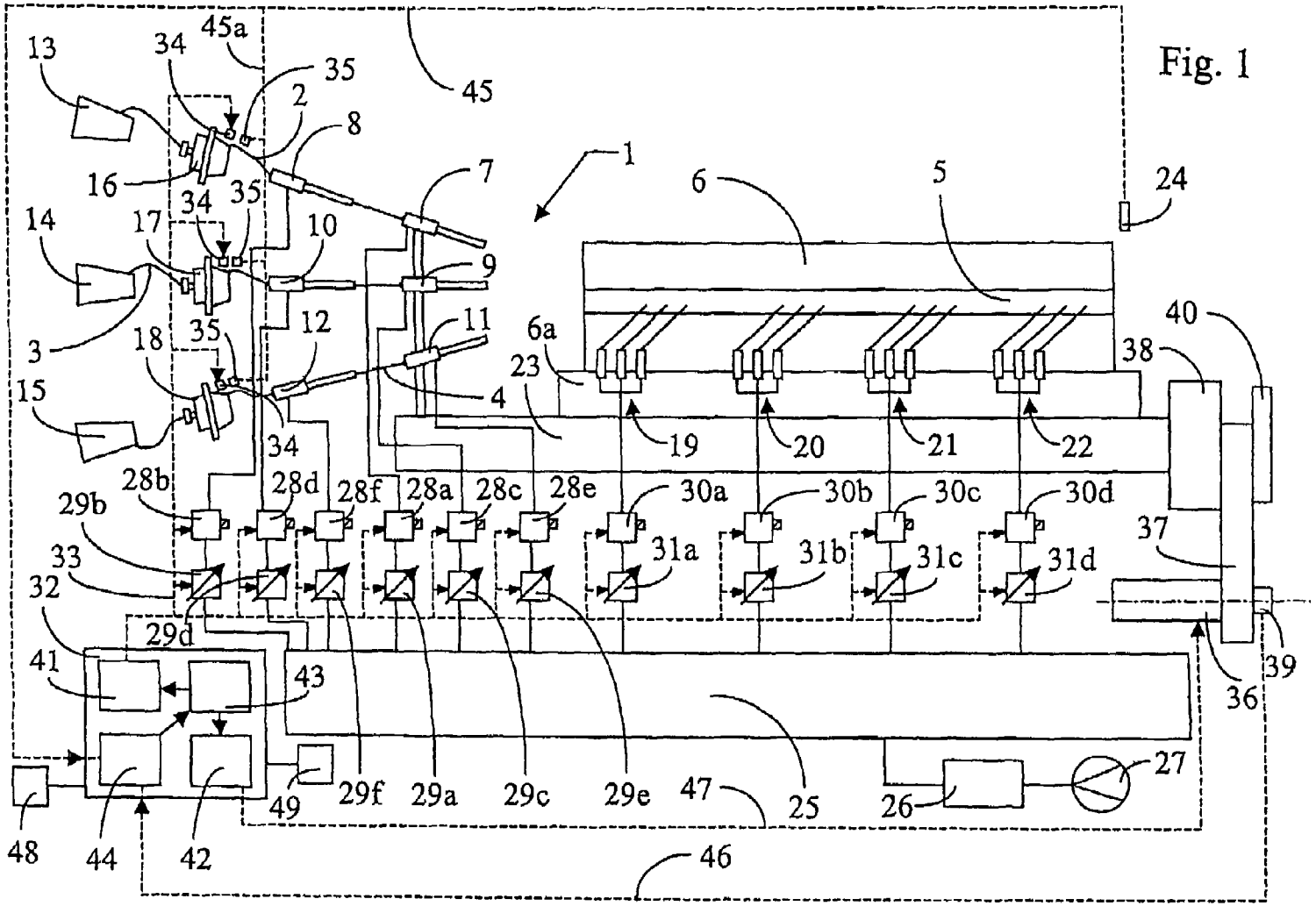
FIG. 1 shows schematically part of an air jet weaving loom according to the invention.

FIG. 1 shows an air jet weaving loom with a device 1 for inserting weft threads. The device 1 can optionally blow a weft thread 2, 3 and/or 4 into a guide channel 5 installed, for example, in a reed 6 in order to transport a weft thread through a weaving shed formed by warp threads. The weft threads that are inserted here in turn according to a pattern, for example, may or may not be of different types. Here a set of main blowers 7 and 8 is provided for the weft thread 2, a set of main blowers 9 and 10 for the weft thread 3, and a set of main blowers 11 and 12 for the weft thread 4. The weft threads 2, 3 and 4 come from a thread supply unit 13, 14 or 15 respectively. A thread preparation device 16, 17 or 18 for a weft thread is provided between each thread supply unit and a corresponding set of main blowers. A weft thread blown into the guide channel 5 is then blown further along the guide channel 5 by air jets from a number of sets of secondary blowers 19, 20, 21 and 22. The air jet weaving loom shown has four sets of secondary blowers each with three secondary blowers. According to a variant, it is also possible, however, for the air jet weaving loom to have a random number of sets of secondary blowers each with a random number of secondary blowers.

The reed 6 that comprises a guide channel 5 is provided on a loom slay 23 by means of a reed holder 6*a*. The guide channel 5 is positioned in a weaving shed by means of the movement of the loom slay 23 in the known manner during the insertion of a weft thread. At the end of the guide channel 5 positioned opposite the main blowers a thread monitor 24 is arranged that can determine when a weft thread arrives at and passes by said thread monitor 24. The main blowers 7, 9 and 11, the sets of secondary blowers 19, 20, 21, 22 and the thread monitor 24 are mounted here on a loom slay 23 in the known manner. The main blowers 8, 10 and 12, the thread supply units 13, 14, 15 and the thread preparation device 16, 17 or 18 are arranged at the frame of the air jet weaving loom in the known manner.

Furthermore, the air jet weaving loom has a reservoir 25 for compressed air that is connected to a compressed air supply 27 via a pressure regulator 26. Between the reservoir 25 and each of the main blowers 7 to 12 is a pneumatic connection is provided that comprises, for example, a shut-off valve 28*a*, 28*b*, 28*c*, 28*d*, 28*e*, 28*f* and a corresponding motor-controlled throttle valve 29*a*, 29*b*, 29*c*, 29*d*, 29*e* and 29*f* respectively. Pneumatic connecting lines for compressed air are also shown that interconnect the above-mentioned compressed air source 25 and main blowers via the corresponding shut-off valves and throttle valves. A throttle valve for an air jet weaving loom is, amongst others, known from and described in detail in WO 99/64651.

According to a possibility not shown, a second pneumatic connection in addition to the above-mentioned pneumatic connection can also be provided in the known manner between the reservoir and each main blower in order to supply compressed air at low pressure to the main blowers while an above-mentioned shut-off valve is closed. Such a second pneumatic connection can, for example, comprise a throttle valve and possibly also a non-return valve.

By analogy, a shut-off valve 30*a*, 30*b*, 30*c* and 30*d*, a corresponding throttle valve 31*a*, 31*b*, 31*c* and 31*d* and corresponding pneumatic connecting lines can be provided between the reservoir 25 and each set of secondary blowers 19, 20, 21 and 22. According to a variant not shown, a separate reservoir can be provided for both the main blowers and the secondary blowers. According to one variant, the throttle valves 31*a*, 31*b*, 31*c* and 31*d* can be omitted.

The pneumatic connections for the main blowers and the secondary blowers are of course not limited to the above-mentioned embodiments with shut-off valves and throttle valves, but can be replaced by any other known pneumatic connection that can provide, set or control the supply of compressed air.

Furthermore, the air jet weaving loom comprises a control unit 32 that is connected to the shut-off valves and the throttle valves by electric connecting leads 33 as shown in FIG. 1. Each throttle valve has, for example, a controllable stepping motor that can be driven in both directions by means of signals from the control unit 32 in order to be able to supply a desired amount of compressed air to a weft thread. The shut-off valves consist for example of electromagnetic valves that at appropriate moments during a weaving cycle can be opened by the control unit 32 to admit compressed air in order to transport a weft thread through the guide channel 5.

Each thread preparation device 16, 17 and 18 comprises a control element 34 that permits a weft thread 2, 3 or 4 to be released and which, for example, is formed by a known magnetic pin. By actuating the control element 34 by means of the control unit 32, a weft thread can be released for an insertion. The appropriately long duration of actuating of the control element 34 also allows a length for a weft thread to be released in the known manner. Each control element 34 is connected to the control unit 32 via electric connecting leads 33.

At each thread preparation device 16, 17 and 18, a thread monitor 35 is provided that, for example, can detect the taking-off of windings from a thread preparation device 16, 17 and 18. The signals from such thread monitors 35 can be supplied to the control unit 32 via electric connecting leads 45, 45*a* in the same way as the signals from the thread monitor 24.

The weaving loom shown in FIG. 1 also comprises a drive motor 36 that drives the loom slay 23 back and forth by means of a drive element 37 and a drive mechanism 38. Such a drive element 37 is described i.a. in WO 98/31856. Here, the drive motor 36 is turned, for example, one complete revolution during each insertion so that the angular position of the drive shaft of the drive motor 36 is the same as the angular position of the weaving loom. The angular position of the drive motor 36 can be determined here by means of an angle sensor 39 that, for example, is connected to the control unit 32 of the weaving loom via an electric connecting lead 46. The drive element 37 comprises, for example, a gear wheel transmission while the drive mechanism 38, for example, comprises a cam mechanism. The drive motor 36 is connected to the control unit 32 via an electric connecting lead 47.

According to one embodiment, the drive motor 36 also drives via the drive element 37 a shed drive unit 40 that forms part of shed forming means that enable a weaving shed to be formed with warp threads. The shed forming means can, for example, comprise weaving frames in the known manner that are driven up and down. This allows a weaving shed to be formed in synchronization with the weaving cycle. According to a variant not shown, the shed forming means can also comprise a shed drive unit that is driven by dedicated drive means that move more or less synchronously with the weaving cycle.

The control unit 32 of the weaving loom has a control device 41 for one or more control parameters for an insertion, a control device 42 for one or more control parameters for a weaving cycle and a selection device 43 for control of the above-mentioned control device 41 for at least one control parameter for an insertion and/or the above-mentioned control device 42 for at least one control parameter for a weaving cycle. Furthermore, the control unit 32 has an evaluating device 44 for determining a representative value for at least one actual insertion parameter. The evaluating device 44 can cooperate with the selection device 43.

Before applying the method according to the invention, it is assumed that basic values for the control parameters for the insertions for the weft threads 2, 3 or 4 to be successively inserted and for the control parameters for the weaving cycle of the weaving loom have been stored in the control unit 32 of the weaving loom. Limit values can also be stored for each of the control parameters, between which these control parameters can be set or varied without risk, in other words a range can be provided for the control parameters. Such a range is limited by a minimum and a maximum limit value for a control parameter. The basic value for a control parameter naturally lies within this range and lies, for example, roughly in the middle between the two limit values.

The stored basic values and/or the stored limit values, in other words the stored range, can be input via an input unit 48 that interacts with the control unit 32. The control unit 32 can also be connected to a display 49 in order to make all values for the insertion parameters and all values for the control parameters visible for an operator. It is clear that the control parameters for the insertion of each successive weft thread 2, 3 or 4 can be stored according to a weaving pattern. During weaving, the control parameters for the different successive weft threads to be inserted can be controlled in accordance with the weaving pattern.

A representative value for at least one actual insertion parameter is first determined using an evaluating device 44. According to one embodiment, such a value can be determined as a mean value over a number of insertions from the time difference between a moment when a weft thread arrives at the thread monitor 24 and a moment when the angle sensor 39 reaches a given angular position. The number of insertions for determining a mean value can also be set, for example twenty insertions, or can be automatically varied as a function of actual insertion parameters, for example between four and two hundred insertions.

If a representative value determined as described above deviates from a preset value, then according to a first possibility the selection device 43 can select an algorithm in order to vary a control parameter for an insertion so that a value determined as described above for a successive weft thread to be inserted comes closer to the preset value, or the deviation between the above-mentioned values comes closer to a preset deviation. If the above-mentioned deviation from a preset value for the weft thread 2 indicates a too slowly inserted weft thread, the throttle valve 29*a*, for example, should be opened more so that more compressed air is supplied to a successive weft thread to be inserted so that it can be expected that said successive weft thread to be inserted will be inserted faster. It is clear that an adaption of a control parameter only needs to be carried out if such a deviation exceeds a certain minimum value, in other words if there is a sufficient deviation that requires an adaption. According to a variant possibility, for example, one or more signals from the thread monitor 35 can be used instead of a signal from the thread monitor 24 in order to determine a representative value for at least one current insertion parameter.

According to another possibility, the selection device 43 can select an algorithm that can vary a control parameter for a weaving cycle in such a way that the determined value for a successive weft thread to be inserted comes closer to the preset value, or the deviation comes closer to a preset deviation. If the above-mentioned deviation for the weft thread 2 indicates a too slowly inserted weft thread, the weaving speed of the weaving loom will be reduced, for example, so that it can be expected that a successive weft thread to be inserted arrives at the thread monitor 24 at a preset angular position of the angle sensor 39, in other words of the drive motor 36. As with the above-mentioned variant possibility, use can be made here also, for example, of one or more signals from a thread monitor 35 that detects the passage of a winding of a weft thread. The weaving speed or the rotational speed of the drive motor 36 can be controlled in a manner similar to that described in EP 1032867 B1.

The invention comprises the choice or selection of which control parameter or control parameters are to be varied according to an algorithm under given circumstances in order to obtain a desired weaving result. For example, the following basic values for certain control parameters are provided that according to the invention should be considered for adaption:

| | |
|---|---|
| Throttle valve 29a | 85% |
| Throttle valve 29b | 75% |
| Throttle valve 29c | 80% |
| Throttle valve 29d | 70% |
| Throttle valve 29e | 82% |
| Throttle valve 29f | 74% |
| Rotational speed | 800 revolutions/minute |

65% and 98% are taken, for example, as limit values for the control parameters for the throttle valves. This means that the control parameters for the throttle valves can be adapted or varied between 65% and 98%. The range for the rotational speed is limited, for example, by limit values of 760 and 820 revolutions/minute.

If the value determined by the evaluating device 44 indicates that the weft thread 2 arrives too early, the selection means 43 can control the control device 42 in such a way that, for example, the throttle valve 29*a* is automatically adapted from 85% to 82% and the throttle valve 29*b* from 756% to 72%. If the weft thread 3 also arrives too early, the throttle valves 29*c* and 29*d* can, for example, be adapted analogously from 80% and 70% to 78% and 68% respectively. If the weft thread 4 also arrives too early, the throttle valves 29*e* and 29*f* can, for example, be adapted analogously from 82% and 74% to 80% and 72% respectively. In this case in which a lower value for the throttle valves is set for all the weft threads, the selection device 43 can control the control device 42 for the weaving cycle in such a way that a control parameter for the weaving cycle is adapted according to an algorithm. In this case, this means that the rotational speed of the weaving loom can be increased, for example from 800 revolutions/minute to 805 revolutions/minute. Subsequently, the selection device 43 can furthermore control the control device 41 for each weft thread according to an algorithm in such a way that said weft thread does not arrive too early or too late by adapting one or more control parameters for an insertion according to an algorithm.

If, for example, the weft threads still arrive too early and, for example, the rotational speed has reached the maximum limit value of 820 revolutions/minute, the selection means 43 will then only adapt the control means 41 for the insertion and no longer the control means 42 for the weaving cycle. By analogy, if for example the throttle valve 29*b* is set to the limit value 98% and the throttle valve 29*a* is also set to the limit value 98%, the selection device 43 will then only adapt the control parameters for the weaving cycle and, for example, set the rotational speed of the weaving loom lower. The algorithm is selected here in such a way that the control parameters do not exceed their set limit values. The intention here, for example, is to ensure that the control parameters for the insertion do not exceed their limit values and that the control parameters for the weaving cycle set the rotational speed as high as possible.

The invention can be advantageously applied to weaving looms that weave according to a speed pattern, in other words where consecutive insertions are woven with a different weaving speed or where the control parameters for the weaving cycle can be varied from weft to weft. If for the weft thread 2 in the above-mentioned example, for example, the control parameters for the throttle valves 29*a* and 29*b* become lower than 80% and 70% respectively, this can result in the selection means 43 varying one or more control parameters for the weaving cycle or the rotational speed with which the weft thread 2 is woven from 800 to 805 revolutions/minute via the control device 42. Subsequently, the value for the throttle valves can rise again in the direction of the basic values of 85% and 75%. If the other weft threads are not transported faster, weaving will only be carried out at a higher rotational speed for the weft thread 2. This allows the rotational speed of the weaving loom to be adapted for each weft thread in such a way that the set basic value for the throttle valves remains more or less constant. This also permits weaving to be carried out faster without blowing too strongly on a weft thread and without causing additional weft faults.

It is clear that different algorithms can be selected. The intention is that the weaving loom itself selects a rotational speed for the weaving cycle at which one or more weft threads are woven by controlling the control parameters. With the control of the control parameters for an insertion, the supply of compressed air can be adapted or regulated in such a way that a representative value for a measured insertion parameter corresponds to a desired value for said insertion parameter. By adapting the rotational speed, it is possible to keep the control parameters for an insertion, such as the setting of the throttle valves, more or less constant or within their limit values. By adapting the control parameters for an insertion, it is also possible in reverse to keep the rotational speed within the limit values.

The selection means 43 take account here of a set basic value for the different control parameters and of limit values between which these control parameters should lie. It is clear that the selection means 43 should control the control parameters for an insertion and the control parameters for a weaving cycle in such a way that these lie as close as possible to their basic value and do not exceed their limit values. In order to achieve an increase in the production of woven fabric, it is preferable however to set the rotational speed of the weaving loom as high as possible and to subsequently leave the throttle valves set more or less to their basic value.

According to a variant embodiment, a control parameter for an insertion is first adapted for each weft thread until it reaches, for example, an intermediate value. A first intermediate value for the throttle valve 29*a* for the weft thread 2, for example, can be 90%; this is a value that lies between the basic value of 80% and the maximum limit value of 98%. A second intermediate value can be 72%. This is a value that lies between the basic value of 80% and the minimum limit value of 65%. If for the weft thread 2 the setting for the throttle valve 29*a* reaches an intermediate value of 90%, the selection means 43 will subsequently allow the rotational speed of the weaving loom to drop. Subsequently, the selection device 43 will again control a control parameter for the throttle valve 29*a*. If the control parameter again reaches the intermediate value 90%, the selection device 43 will again command the control unit 42 to reduce the rotational speed of the weaving loom. By analogy, in the event of the intermediate value of 72% being reached for a control parameter for the throttle valve 29*a*, the selection device 43 will command the control unit 42 to adapt a control parameter for the weaving cycle so that the rotational speed of the weaving loom is increased.

It is clear that the invention can be most advantageously employed if the rotational speed is not to be reduced rapidly and is to be increased relatively quickly. In the above-mentioned case, for example, 76% and 96% can be selected as limit values for the throttle valve 29*a*. This allows weaving to be carried out faster for a certain period without any significant risk of an insertion parameter exceeding a limit value.

Other algorithms can naturally also be used according to the invention. For example, the control parameters for an insertion can first be adapted until they reach an intermediate value and then the rotational speed of the weaving loom can be adapted until it also reaches an intermediate value. An intermediate value for the rotational speed of the weaving loom in the example can be 810 revolutions/minute. After reaching said intermediate value for the rotational speed, the control parameters for an insertion can subsequently be controlled again until they reach a given intermediate value, and subsequently the rotational speed of the weaving loom is adapted again until a following intermediate value is reached, for example 815 revolutions/minute. In this way, the selection device can cause to adapt according to a certain selection method or a certain algorithm either a control parameter for an insertion or a control parameter for a weaving cycle according to a suitable algorithm in order to transport certain weft threads into a weaving shed at an appropriate rotational speed of the weaving loom using appropriate control signals for an insertion. By analogy, an intermediate value of 790 revolutions/minute or 785 revolutions/minute can be determined if the rotational speed is to be reduced. In this way, the rotational speed of the weaving loom is only adapted at given moments while the control parameters for an insertion can be adapted more or less continuously.

Another possible selection method can consist, alternately, in a case that a given insertion parameter further involves in the same direction in adapting a control parameter for an insertion and in appropriately adapting a control parameter for a weaving cycle. In the case of a weft thread that becomes easier to transport by air as it is woven further off a bobbin, this means for example that the throttle valve 29*a* should first be adapted from 85% to 83% and subsequently the rotational speed should be adapted from 800 to 805 revolutions/minute, subsequently the throttle valve 29*a* should be adapted to 81%, then the rotational speed should be adapted to 810 revolutions/minute, then the throttle valve 29*a* should be adapted to 79%, and so on. The alternating adaption of control parameters for an insertion and control parameters for a weaving cycle enables a stable system to be obtained.

According to a further selection method, an algorithm can be selected with which not only at least one control parameter for an insertion is adapted but also a control parameter for a weaving cycle. According to a variant selection method, not only at least one control parameter for a weaving cycle but also a control parameter for an insertion is adapted. If, for example, a large change in an insertion parameter is discovered, for example after a changeover from an empty bobbin to a full bobbin, so that the weft thread arrives far too late, both the rotational speed of the weaving loom can be decreased and the throttling by the throttle valves can be reduced at the same time. In the case of a significant change in an insertion parameter, this enables a desired setting of the control parameters to be quickly achieved through a combined action of control parameters for an insertion and of control parameters for a weaving cycle.

In the event that all the weft threads are woven at the same rotational speed, a choice can be made to adapt the rotational speed to the setting of the control parameters for a given weft thread. The most critical weft thread is normally selected for this, in other words the weft thread that is most sensitive to changes in an insertion parameter. In the event that the weft thread 2 is chosen, the throttle valve 29*a* should for example, be changed between values of 82% to 88% in the above-mentioned example. The rotational speed of the weaving loom can then be subsequently adapted so that the throttle valve 29*a* remains set in each case between 82% and 88%. If the throttle valves 29*b* to 29*e* hereby exceed their range, then it can be decided not to change the rotational speed further and the throttle valve 29*a* can, for example, be changed further beyond the above-mentioned values until the limit values of 65% and 98% are reached. This offers the advantage that the most critical weft thread can normally be woven with basic values for a throttle valve, while the less critical weft threads will be subjected to a larger change in the settings of the corresponding throttle valves.

It is clear that an insertion parameter does not necessarily have to be determined on the basis of a signal from a single thread monitor. Signals from both a thread monitor 24 and from a thread monitor 35 can also be used to determine an insertion parameter. This offers the advantage that an incorrectly measured signal from one of the thread monitors can be easily detected by comparing the signals from the different thread monitors with one another.

The insertion parameters for the sets of secondary blowers 19, 20, 21 and 22 are preferably input and stored in the control unit 32 as a function of the angular position of the weaving loom. This offers the advantage that in the case of a change or adaption of the weaving speed, the control parameters for the secondary blowers can be retained and/or the control times for the shut-off valves for the secondary blowers can be easily converted into time signals on the basis of the angular positions.

The same can be provided for the control times of the shut-off valves for the main blowers. It is thus clear that the moments when the shut-off valves are actuated are dependent on the rotational speed of the weaving loom, but that the control parameters for the shut-off valves that are determined as angular positions do not have to be changed. It is of course also possible to also adapt the control parameters for the shut-off valves when changing the rotational speed of the weaving loom.

Notwithstanding the control parameters for the throttle valves described in the examples are regulated, according to a variant the pressure regulator 26, for example, can also be regulated and/or controlled as a control parameter for an insertion in order to influence an insertion parameter. The control times of the shut-off valves, the control times of a control element 34 and other control parameters for an insertion can also be selected as control parameters for an insertion. Preference is given, however, to the choice of a control parameter for a throttle valve for a main blower as control parameter for an insertion.

It is clear that the percentage settings for the throttle valves and the rotational speeds of the weaving loom are only given as examples and can be easily replaced by other settings or parameters. These percentages can be replaced, for example, by positions of the throttle valves that are expressed for example in steps of a stepping motor for a throttle valve in relation to a reference position of the throttle valve.

In the description, the control devices 41 and 42, the selection device 43 and the evaluating device 44 are described as separate devices for the sake of clarity with a function being allocated to each device. It is clear, however, that they can be physically integrated into a single device, for example into one single electronic printed circuit board.

The invention can be easily employed on a weaving loom that is already equipped with a controllable drive motor 36 in order to be able to adapt the weaving speed. It is clear that such a weaving loom is not limited to the illustrative embodiments. According to a variant embodiment, a drive motor can drive the loom slay 23 directly, for example in a manner as described in WO 98/31856.

In addition to the above-mentioned thread monitors 24 and 35, other thread monitors can of course be used that allow an actual insertion parameter to be determined. It is obvious that the weaving loom is not limited to an air jet weaving loom on which a weft thread is blown directly into a guide channel 5 with compressed air, but that the weaving loom can consist of any other kind of weaving loom on which a weft thread is transported into a weaving shed by means of compressed air.

The invention can be particularly advantageously employed for the weaving of weft threads where the characteristics of the weft threads change, depending on their position in a thread supply unit or bobbin, such as is the case for example with some filament threads.

The method and the weaving loom according to the invention described in the claims are not limited to the illustrative embodiments shown and described, but can also comprise variants and combinations thereof that are covered by the claims.

The invention claimed is:

1. A method for inserting of a weft thread in a weaving loom wherein said weaving loom includes a control unit arranged to control a control parameter for an insertion of a weft thread and to control a control parameter for a weaving cycle, wherein:

said control unit is configured for adapting at least one said control parameter for the insertion of the weft thread according to a first algorithm and at least one said control parameter for a weaving cycle including said insertion of the weft thread according to a second algorithm; said method comprising the step of:

said control unit selecting either said control parameter for the insertion of the weft thread, said control parameter for the weaving cycle, or both said control parameter for the insertion of the weft thread and the control parameter of the weaving cycle to be adapted for the insertion;

wherein the selection is made in accordance with a set basic value for the different control parameters and limit values between which these control parameters should lie.

2. The method according to claim 1, wherein the adaption is effected as a function of at least one insertion parameter.

3. The method according to claim 1, wherein the adaption is effected as a function of at least one control parameter for an insertion.

4. The method according to claim 1, wherein the adaption is effected as a function of at least one control parameter for a weaving cycle.

5. The method according to claim 1, wherein at least one control parameter for an insertion and at least one control parameter for a weaving cycle are alternately adapted.

6. The method according to claim 1, wherein the control parameter or the control parameters to be varied are selected such that a rotational speed of the weaving loom is set as high as possible.

7. The method according to claim 1, wherein the control parameter or the control parameters to be varied are selected such that the at least one control parameter for the insertion and the at least one control parameter for the weaving cycle lie as close as possible to their basic value and do not exceed their limit values.

8. The method according to claim 1, wherein a control parameter is regulated as a function of a representative value for at least one current insertion parameter.

9. The method according to claim 1, including inputting at least one basic value for a control parameter.

10. The method according to claim 1, including inputting at least one limit value for a control parameter.

11. The method according to claim 1, including setting the rotational speed for each insertion at the same value.

12. The method according to claim 1, including setting the rotational speed for each insertion at a different value.

13. The method according to claim 1, including inserting weft threads on a weaving loom, said weft threads being supplied from more than one weft thread supply unit, wherein insertion parameters of the weft threads coming from each of the weft thread supply units are determined and evaluated such that at least one control parameter for the insertion of the weft threads coming from the respective weft thread supply unit is adapted according to either or both said first algorithm and at least one control parameter for a weaving cycle that is adapted according to said second algorithm.

14. A weaving loom, comprising:

a first control device for a control parameter for a weft insertion;

a second control device for a control parameter for a weaving cycle;

a selection device enabling control of either or both the first control device for a control parameter for a weft insertion according to a first algorithm and the second control device for a control parameter for a weaving cycle according to a second algorithm;

wherein the selection device is arranged so that the control parameter or control parameters are selected under given circumstances, taking into account a set basic value for the different control parameters and limit values between which these control parameters should lie.

15. The weaving loom according to claim 14, wherein the selection device operates together with an evaluating device for determining a representative value for at least one current insertion parameter.

16. The weaving loom according to claim 14, wherein said control devices are configured for adapting at least one said control parameter for the insertion of the weft according to a first algorithm and at least one said control parameter for a weaving cycle including said insertion of the weft according to a second algorithm and said selection device and control devices are arranged to carry out the the step of:

selecting either said control parameter for the insertion of the weft, said control parameter for the weaving cycle, or both said control parameter for the insertion of the weft and the control parameter of the weaving cycle to be adapted for the insertion;

wherein the selection is made in accordance with a set basic value for the different control parameters and limit values between which these control parameters should lie.

* * * * *

UNITED STATES PATENT AND TRADEMARK OFFICE

CERTIFICATE OF CORRECTION

PATENT NO. : 7,762,288 B2
APPLICATION NO. : 12/085636
DATED : July 27, 2010
INVENTOR(S) : Patrick Puissant It is certified that error appears in the above-identified patent and that said Letters Patent is hereby corrected as shown below:

Title page, item [73] change the assignee city on the first page of the above-identified patent from "Leper" to -- Ieper --.

Signed and Sealed this

Fourteenth Day of September, 2010

David J. Kappos

David J. Kappos
*Director of the United States Patent and Trademark Office*